United States Patent [19]

Lobrovich

[11] Patent Number: 4,502,683

[45] Date of Patent: Mar. 5, 1985

[54] PIVOTAL CUE SUPPORT

[76] Inventor: Steve Lobrovich, 41939 McKay St., Fremont, Calif. 94538

[21] Appl. No.: 458,406

[22] Filed: Jan. 17, 1983

[51] Int. Cl.[3] ..... A63D 15/10

[52] U.S. Cl. ..... 273/23

[58] Field of Search ..... 273/23, 24

[56] References Cited

U.S. PATENT DOCUMENTS

| | | | |
|---|---|---|---|
| 774,862 | 11/1904 | Blackburn | 273/23 |
| 898,345 | 9/1908 | Farnham | 273/23 |
| 968,187 | 8/1910 | McIntire | 273/23 |

FOREIGN PATENT DOCUMENTS

| | | | |
|---|---|---|---|
| 3449 | of 1878 | United Kingdom | 273/23 |
| 17483 | of 1903 | United Kingdom | 273/23 |
| 19470 | of 1912 | United Kingdom | 273/23 |

*Primary Examiner*—Richard C. Pinkham

*Assistant Examiner*—T. Brown

*Attorney, Agent, or Firm*—Townsend and Townsend

[57] ABSTRACT

A pivotal cue support including an elongate handle, a cue rest pivotally mounted to the outer end of the handle for movement about a pivot axis and a remotely actuated lock assembly mounted within the handle. The lock assembly includes a brake pad at the far end of an elongate actuating rod. The pivotal mounting assembly has an arcuate brake surface shaped to conform to the abutting surface of the brake pad. The cue rest is locked into place by forcing the actuating rod toward the pivotal mounting assembly to push the brake pad against the brake surface. This is accomplished by manipulation of a lock actuator mounted near the grip end of the handle. Movement of the lock actuator forces the brake pad against the brake member to lock the cue rest in place.

8 Claims, 4 Drawing Figures

PIVOTAL CUE SUPPORT

BACKGROUND OF THE INVENTION

This invention relates to cue supports or bridges, particularly one having a cue rest pivotally mounted to the outer end of the handle.

During the play of billiards or pool a player may need to use what is known as a cue support or bridge. The bridge has an elongate handle to which a cue rest is mounted at its outer end. The cue rest has a number of notches for supporting the end of the pool cue. Awkward shots, which would otherwise not be possible, can often be made with the aid of a bridge. However it often happens that while using the bridge the shaft or handle of the bridge interferes with the use of the pool cue. This is so because the cue rest often must be positioned among the balls on the playing surface in a restricted manner which limits the orientation of the bridge handle.

U.K. Pat. No. 17,483 to Deaville discloses a bridge having a cue guide which can be moved from side to side. The cue guide is manipulated by rotating the handle of the bridge causing the cue guide to move through the action of a pair of bevel gears. However, once the cue support is resting on the playing surface, it is not possible to simply swing the handle out of the way. Rather, articulation of the cue guide relative to the handle is only possible by rotation of the handle. This exercise can become tedious and may cause the cue rest to shift on the table. This is undesirable since any movement of the cue rest may bump the balls—quite unsatisfactory.

SUMMARY OF THE INVENTION

The present invention is directed to a pivotal cue support including an elongate handle, a cue rest pivotally mounted to the outer end of the handle for movement about a pivot axis, and a remotely actuated lock assembly. The lock assembly includes a brake pad at the far end of an elongate actuating rod housed within the hollow handle. The pivotal mounting assembly has an arcuate brake surface shaped to conform to the abutting brake pad surface. In one embodiment the actuating rod and brake pad are normally biased away from the pivotal mounting assembly to allow substantially free relative pivotal movement between the cue rest and the handle.

The cue rest is locked into place by forcing the brake pad against the brake surface of the pivotal mounting assembly. This is accomplished by manipulation of a lock actuator mounted to the handle. The lock actuator is preferably located near the grip end of the handle. Movement of the lock actuator forces the actuating rod toward or away from the cue rest to lock or release the cue rest.

A primary feature of the invention is the provision of a pivotal mounting assembly which allows relative pivotal movement between the handle and the cue rest about a single, typically vertical, pivot axis. This pivotal action is substantially unhindered to allow the user to easily move the handle of the bridge out of the way without disturbing the position of the cue rest on the playing surface.

Another feature of the invention is the use of a remotely placed lock actuator. This provides the user with the ability to lock the cue rest in place from a position near the grip end of the handle. The lock assembly also allows the cue rest to be locked in an infinite number of positions without disturbing the cue rest.

The pivotal mounting assembly includes a brake member mounted to the outer end of the handle by a pair of coaxial pins. The brake member is preferably spherical to provide complementary spherical braking surfaces between the brake pad and the brake member. The force exerted on the brake member is resisted by the mounting pins. The actuating rod, centered within the handle by a number of guides, exerts a force on the brake member along an axis passing through the pivotal mounting axis of the pins. This eliminates any tendency for the brake member to rotate when locked into place by the brake pad.

Other features and advantages of the present invention will appear from the following description in which the preferred embodiment has been set forth in detail in conjunction with the accompanying drawings.

DETAILED DESCRIPTION OF THE PREFERRED EMBODIMENT

Figures 1, 2:
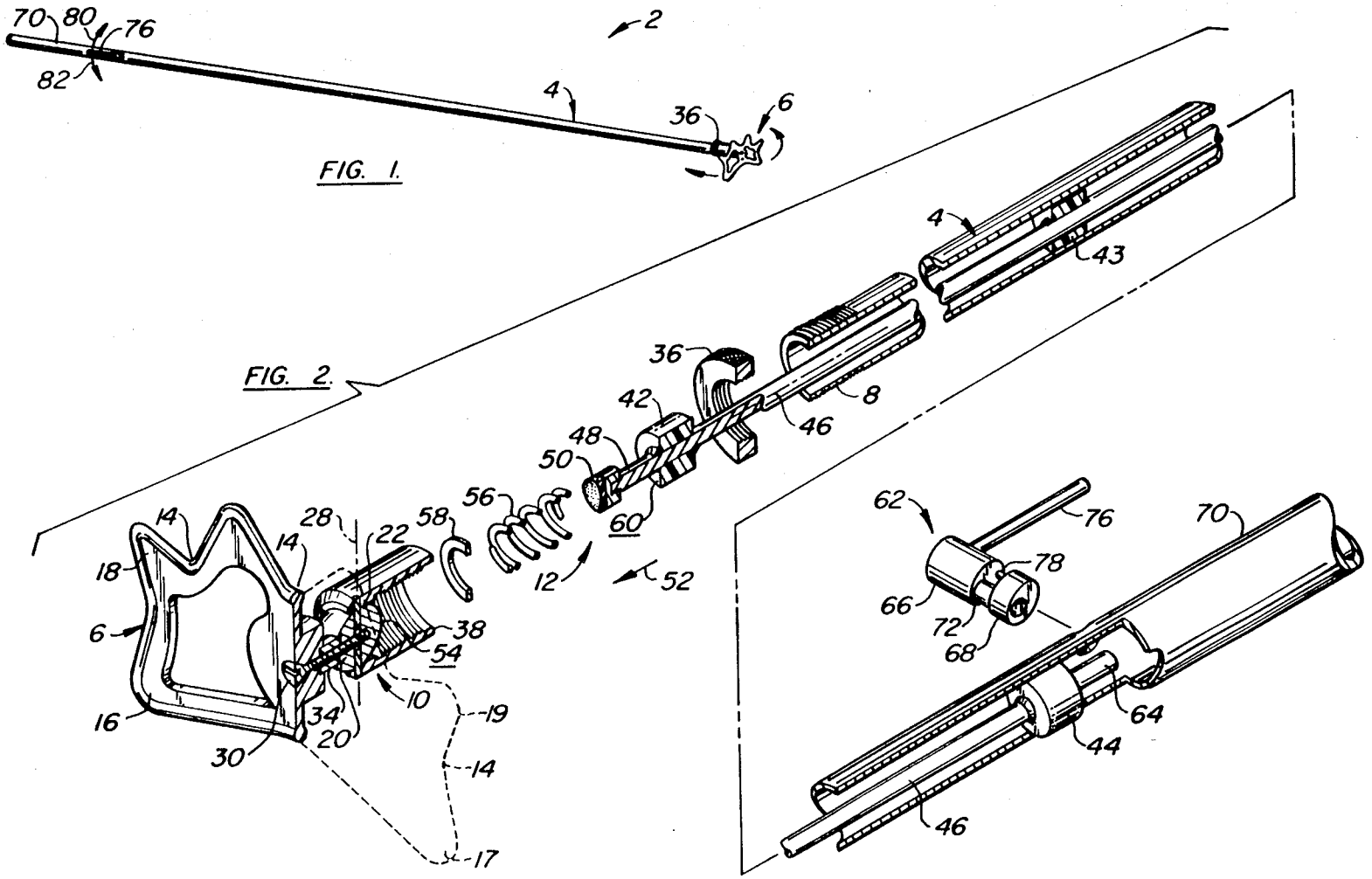
FIG. 1 is an overall perspective view of the pivotal cue support of the invention.
FIG. 2 is an exploded cross-sectional isometric view of the cue support of FIG. 1.

Turning now to the figures, bridge 2 includes broadly a handle 4, a cue rest 6 pivotally mounted to the outer end 8 of handle 4 by a pivotal mounting assembly 10. Cue rest 6 is locked into place using a pivot lock assembly 12 as described below.

Cue rest 6 is of standard design and has a number of notches 14 formed in its periphery for resting the tip of a pool cue therein. Rest 6 can be used either with portions 16, 17 resting on the playing surface or can be used with portions 16 and 18 or 17 and 19 resting on the playing surface, depending upon which notch 14 is to be used.

Mounting assembly 10 includes a spherical brake member 20 pivotally mounted to one end of a tubular mounting adaptor 22 by a pair of coaxial mounting pins 24 extending inwardly within adaptor 22. Mounting pins 24 fit within a circular bore 26 in member 20, bore 26 being slightly oversized to allow brake member 20 to rotate about a pivot axis 28 defined by pins 24. A screw 30 connects cue rest 6 to brake member 20 by threadably engaging a threaded hole 32 formed within member 20. A tubular stand-off 34 keeps rest 6 and member 20 spaced apart an appropriate distance. Pivotal mounting assembly 10 allows cue rest 6 and handle 4 to pivot relative to one another about pivot axis 28. Assuming pivot axis 28 is vertical, the pivot path of cue rest 6 will be horizontal.

Mounting adaptor 22 has internal threads for engagement with the external threads at outer end 8 of handle 4. A knurled, threaded ring 36 is used to jam against the shoulder 38 of mounting adaptor 22 to lock adaptor 22 in place.

Pivot lock assembly 12 includes an elongate actuating rod 40 centered within handle 4 by a number of generally cylindrical guides 42, 43, 44. The guides are preferably made from a plastic material and are sized to allow rod 40 to move easily along axis 46 of handle 4, which coincides with the axis of rod 40. Guides 42-44 are fixed to actuating rods 40 using an adhesive. The far end 48 of rod 40 is threaded and has a threaded bearing member 49 mounted thereto. A brake pad 50 is mounted to its forward face. Movement of rod 40 and brake pad 50 therewith in a forward direction 52 along axis 46 causes pad 50 to contact the outer, brake surface 54 of braking member 20. When done with sufficient force this lock cue rest 6 in position relative to handle 4.

Pivot lock assembly includes a spring 56 captured between a washer-like spring stop 58 and the forward face 60 of guide 42. Thus, brake pad 50 is normally biased by spring 56 away from brake member 20 to place bridge 2 in an unlocked or released, freely pivoting mode.

Pivot lock assembly 12 also includes a lock actuator assembly 62 mounted adjacent the near end 64 of actuating rod 40. Lock actuator assembly 62 includes a pair of coaxial cylindrical members 66, 68 positioned within complementary holes in handle 4 near the grip end 70 of actuating rod 40. An eccentric pin 72 connects members 66, 68. The distance separating cylindrical members 66, 68 is slightly greater than the diameter of rod 40 at near end 64. This allows the rearward face 74 of actuating rod 40 to rest against pin 72 through the urging of spring 56. An actuator handle 76 is mounted to cylindrical member 66 external of handle 4. Rotation of handle 76 causes eccentric pin 72 to move axially and radially within handle 4. Face 74 of actuating rod 40, under the bias of spring 56, follows the axial position of pin 72. Movement of handle 76 is limited by a stop pin 78 extending from member 66 toward member 68.

Figure 3A:
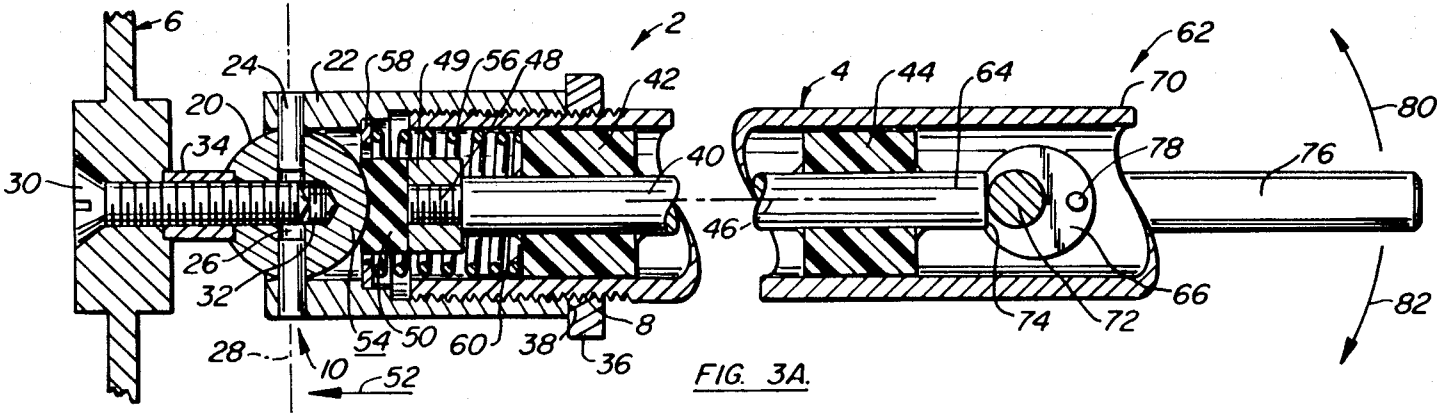
FIGS. 3A and 3B are cross-sectional side views of the cue support of FIG. 1 in locked and unlocked conditions respectively.

The cue rest 6 is locked at the desired orientation by placing actuator handle 76 parallel to handle 4 of bridge 2 as shown in FIG. 3A. This orientation drives eccentric pin 72 forward in the direction of arrow 52 thus driving actuating rod 40 towards spherical brake member 20. This movement causes brake pad 50 to press against brake surface 54 of member 20 to keep 20 from pivoting about axis 28. The concentric placement of actuating rod 40 within handle 4 by guides 42-44 ensures that rod 40 moves along a path colinear with axis 46. This allows the force exerted on spherical braking member 20 to be exerted through axis 28 where it is resisted by pins 24. Such proper positioning effectively eliminates applying forces to member 20 off-axis of pivot axis 28. This assures that when brake pad 50 contacts member 20, unintended shifting of member 20 about axis 28 is eliminated.

Figure 3B:
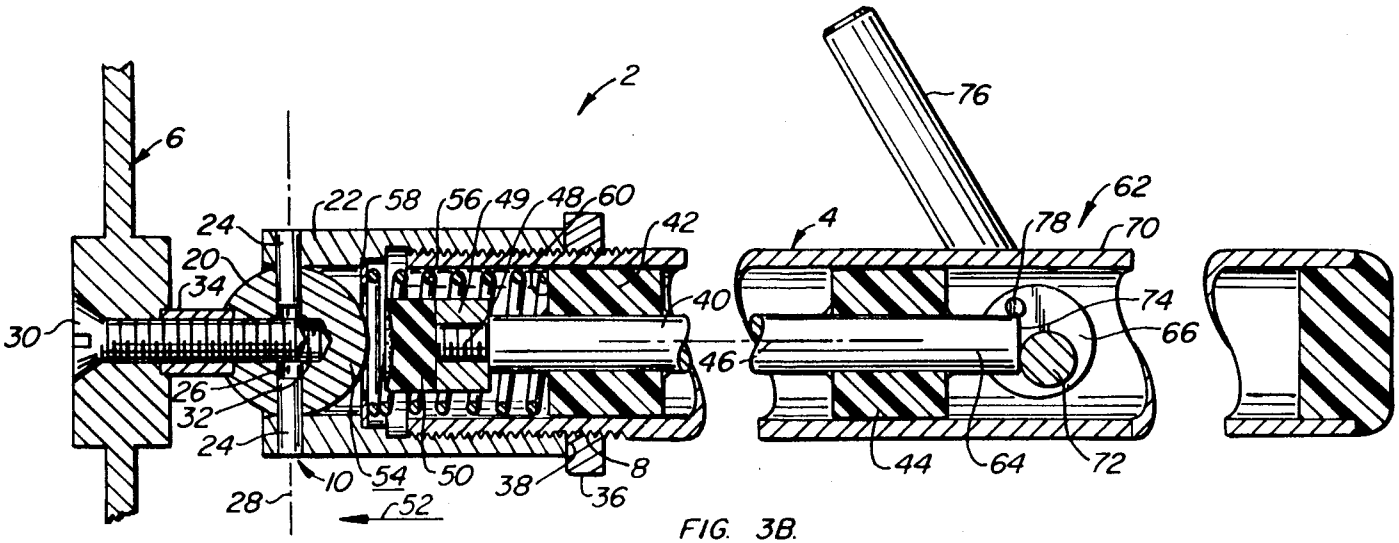

To allow cue rest 6 to pivot freely about axis 28, actuator handle 76 is rotated in the direction of either arrow 80 or arrow 82. FIG. 3B illustrates handle 76 rotated in the direction of arrow 80 until stop pin 78 engages actuator rod 40. This movement of handle 76 moves eccentric pin 72 in a rearward direction opposite forward direction 52. Spring 56 keeps rearward face 74 of rod 40 engaged with eccentric pin 72 so that brake pad 50 disengages brake surface 54. This allows the rest 6 to pivot freely about axis 28.

In use the player will typically place portions 16, 17 of cue rest 6 on the playing surface adjacent the cue ball. At this time cue rest 6 is locked in place as shown in FIG. 3A. If handle 4 obstructs the user's manipulation of the pool cue, actuator handle 76 is rotated in the direction of either arrows 80 or 82 allowing handle 4 to pivot about axis 28 and out of the way. The user can then lock handle 4 in this offset orientation, by moving handle 76 back into alignment with handle 4, and take the shot.

Modification and variation can be made to the disclosed embodiment without departing from the subject of the invention as defined in the following claims.

I claim:

1. A pivotal cue support comprising:

an elongate handle having a handle end and an outer end;

a cue rest;

means for pivotally mounting said cue rest to said outer end allowing said cue rest substantially unhindered pivotal movement along at least one pivotal path, said pivotal mounting means including a brake surface; and means for selectively locking said cue rest at a chosen pivotal orientation with respect to said handle said locking means including a brake pad, means for resiliently biasing said brake pad away from said brake surface, and remotely actuated drive means for urging said brake pad against said brake surface to lock said pivotal mounting means and cue rest therewith at said chosen pivotal orientation.

2. The cue support of claim 1 wherein said handle has a hollow portion from an operating position near said handle end to said outer end.

3. The cue support of claim 2 wherein said brake pad urging means includes an actuator rod housed substantially within said hollow portion and operable from said operating position.

4. The cue support of claim 1 wherein said pivotally mounting means includes means for limiting the pivotal movement of said cue rest to said at least one pivotal path.

5. The cue support of claim 1 wherein:

said handle has a hollow portion from said outer end to an operating position; and said remotely actuating rod housed within said hollow portion having a far end adjacent said brake pad and a near end adjacent said operating position and a manual actuator means, mounted to said handle at said operating position, for selectively biasing said near end of said rod toward said brake pad.

6. The cue support of claim 5 wherein said manual actuator means includes an eccentric pin positioned to engage said near end of said rod.

7. The cue support of claim 5 wherein said operating position is near said handle end.

8. The cue support of claim 1 wherein said brake surface is an arcuate surface.

* * * * *